United States Patent [19]

Masuda et al.

[11] Patent Number: 4,935,338

[45] Date of Patent: Jun. 19, 1990

[54] SILVER HALIDE PHOTOGRAPHIC MATERIAL CONTAINING AQUEOUS LATEX HAVING COATED POLYMER PARTICLES

[75] Inventors: Kosaku Masuda, Akishima; Eiichi Ueda; Noriki Tachibana, both of Hino, all of Japan

[73] Assignee: Konishiroku Photo Industry Co., Ltd., Tokyo, Japan

[21] Appl. No.: 246,939

[22] Filed: Jul. 15, 1988

Related U.S. Application Data

[63] Continuation of Ser. No. 157,162, Feb. 11, 1988, abandoned, which is a continuation of Ser. No. 918,765, Oct. 14, 1986, abandoned.

[30] Foreign Application Priority Data

Oct. 16, 1985 [JP] Japan ..... 60-230493
Oct. 17, 1985 [JP] Japan ..... 60-232262

[51] Int. Cl.[5] ..... G03C 1/02

[52] U.S. Cl. ..... 430/631; 430/627; 430/628; 430/634; 430/637; 430/639; 430/642

[58] Field of Search ..... 430/631, 633, 637, 627, 430/628, 642, 634, 636, 639

[56] References Cited

U.S. PATENT DOCUMENTS

| | | | |
|---|---|---|---|
| 3,142,568 | 7/1964 | Nottorf . | |
| 3,493,379 | 2/1970 | Donoghue . | |
| 3,525,620 | 8/1970 | Nishio et al. . | |
| 3,772,032 | 11/1973 | Pearson et al. . | |
| 4,199,363 | 4/1986 | Chen | 430/631 |
| 4,245,036 | 1/1981 | DeWinter et al. | 430/631 |
| 4,368,258 | 1/1983 | Fujiwhara et al. | 430/631 |
| 4,510,238 | 4/1985 | Kingston et al. | 430/631 |
| 4,513,080 | 4/1985 | Heuling | 430/631 |
| 4,518,354 | 5/1985 | Yokoyama et al. | 430/631 |
| 4,551,424 | 11/1985 | Ideda et al. | 430/631 |

FOREIGN PATENT DOCUMENTS

| | | |
|---|---|---|
| 708347 | 11/1968 | Belgium . |
| 768558 | 4/1971 | Belgium . |
| 2049150 | 4/1971 | Fed. Rep. of Germany . |
| 45-5331 | 3/1970 | Japan . |
| 48-52883 | 2/1973 | Japan . |
| 48-52882 | 11/1973 | Japan . |
| 53-39118 | 2/1978 | Japan . |
| 54-19772 | 5/1979 | Japan . |
| 55-50240 | 1/1980 | Japan . |
| 55-47371 | 7/1980 | Japan . |
| 1498697 | 3/1978 | United Kingdom . |

OTHER PUBLICATIONS

Japanese Patent Report vol. 82, No. 8, section CH, Mar. 26, 1982, Class G, p. 2, No. J8-2009050, Derwent Publications, London, GB.

*Primary Examiner*—Jack P. Brammer
*Attorney, Agent, or Firm*—Jordan B. Bierman

[57] ABSTRACT

A silver halide photographic material is disclosed, which has at least one silver halide emulsion layer on a support, said silver halide emulsion layer containing a latex which has been stabilized by a protective colloid which is at least one substance selected from among natural water-soluble polymers, derivatives thereof, and synthetic hydrophilic polymers having at least one nonionic group and at least one anionic group in the molecular structure.

8 Claims, No Drawings

SILVER HALIDE PHOTOGRAPHIC MATERIAL CONTAINING AQUEOUS LATEX HAVING COATED POLYMER PARTICLES

This application is a continuation of application Ser. No. 157,162, filed Feb. 11, 1988, now abandoned which is a continuation of application Ser. No. 918,765, filed Oct. 14, 1986, now abandoned.

BACKGROUND OF THE INVENTION

The present invention relates to a silver halide photographic material containing a synthetic high-molecular weight substance in a silver halide emulsion layer. More particularly, the present invention relates to a silver halide photographic material containing a latex in a silver halide emulsion layer.

Latices are currently used in combination with gelatin as binders in silver halide photographic materials in order to reduce the amount of gelatin needed and to provide coatings having improved properties such as those with respect to dimensional stability (both in the face of development and after exposure to wet heat), flexibility, pressure resistance and drying speed. However, the use of latices causes serious effects on photographic performance as manifested by the desensitization of emulsion, devitrification during development, color staining of dyes after development, and deteriorated quality of dots in the light-sensitive material used for making printing plates. Various proposals have been made with a view to solving these problems. According to U.S. Pat. No. 3,525,620, Belgian Patent No. 768,558, U.S. Pat. Nos. 3,142,568 and 3,325,286, Belgian Patent No. 708,347, German Patent No. 2,049,150, British Patent No. 1,498,697 and Japanese Patent Publication No. 5331/1970, 50969/1984 (the term OPI as used hereinafter means an Unexamined Published Japanese Patent Application); it is proposed that the aforementioned problems be solved by polymerizing latices with specified activating agents. However, these methods are applicable to only limited types of emulsions and none of them can be practiced without causing adverse effects on fogging, sensitivity and development characteristics. Latices may be emulsion-polymerized in the presence of low-molecular weight surfactants but this method can be applied to only limited combinations of latices and silver halide emulsions and, in addition, the amount of latices that can be incorporated in the emulsion is also limited.

Japanese Patent Application (OPI) No. 50240/1980, Japanese Patent Publication Nos. 47371/1980 and 19772/1979, and Japanese Patent Application (OPI) Nos. 52882/1973 and 52883/1973 disclose techniques which attempt to solve the aforementioned problems by incorporating in silver halide emulsions those latices which have been emulsion-polymerized in the presence of a high-molecular weight protective colloid. These latices do not cause substantial adverse effects on photographic performance but they present problems associated with the fabrication of photographic materials such as devitrification during development, increase in the viscosity of coating solutions, difficulty in applying more than one layer simultaneously, and cissing during the coating operation. In short, from the viewpoint of photographic performance, polymer latices protected with high-molecular weight colloids are advantageously employed in order to provide coatings having improved properties but these latices have many problems associated with the manufacturing process such as devitrification during development and the increase in viscosity or occurrence of cissing during coating operations. Photographic materials employing latices that are protected with high-molecular weight colloids have not yet been commercialized.

SUMMARY OF THE INVENTION

One object, therefore, of the present invention is to provide a latex-incorporating silver halide photographic material that has no latex-associated problem either in terms of photographic performance or with respect to the manufacturing process, and which yet produces a coating having improved properties such as those regarding dimensional stability.

This object can be achieved by a silver halide photographic material that has at least one silver halide emulsion layer on a support, said silver halide emulsion layer containing a latex which has been stabilized by a protective colloid which is at least one substance selected from among natural water-soluble polymers, derivatives thereof, and synthetic hydrophilic polymers having at least one nonionic group and at least one anionic group in the molecular structure.

DETAILED DESCRIPTION OF THE INVENTION

The latex used in the present invention has been stabilized by a protective colloid which is at least one substance selected from among natural water-soluble polymers, derivatives thereof, and synthetic hydrophilic polymers having at least one nonionic group and at least one anionic group in the molecular structure.

In the pages that follow, the natural water-soluble polymers and derivatives thereof with which the latex used in the present invention may be stabilized by a protective colloid are described in detail.

Details of the natural water-soluble polymers that may be used in the present invention are given in the Technical Data Book of water-soluble high-molecular weight water-reducible resins published by Keiei Kaihatsu Center (Management Development Center). Illustrative natural water-soluble polymers include lignin, starch, pullulan, cellulose, alginic acid, dextran, dextrin, guar gum, gum arabic, glycogen, laminarin, lichenin, nigeran, and derivatives thereof.

Particularly preferred derivatives of the natural water-soluble polymers include sulfonated, carboxylated, phosphated, sulfoalkylenated, carboxyalkylenated, alkylphosphated natural water-soluble polymers, as well as salts thereof.

Two or more of the natural water-soluble polymers listed above may be used in combination in the present invention. Among the natural water-soluble polymers, glucose polymers and derivatives are preferable, with starch, glycogen, cellulose, lichenin, dextran and nigeran being particularly preferable. Most preferable examples are dextran and derivatives thereof.

Dextran is a polymer of $\alpha$-1,6 linked D-glucose units, Dextran is usually obtained by culturing dextran-producing bacterial in the presence of saccharides. More specifically, dextran may be obtained by first isolating dextran sucrase from a culture solution of dextran-producing bacterium such as Leuconostoc mesenteroides, then causing the isolated dextran sucrase to react with a saccharide. Native dextrans obtained by these methods may be subjected to partial decomposition polymerization with acid- or alkali-working enzymes so as to reduce the molecular weights of the dextrans to predetermined levels that provide them with intrinsic viscosities within the range of 0.03 to 2.5.

Modified products of dextran include: dextran sulfate esters wherein a sulfuric acid group is present in the form of an ester linkage in the molecule of dextran, and salts thereof; carboxyalkyl dextran wherein a carboxyalkyl group is present in the form of an ether linkage in the molecule of dextran; carboxyalkyl dextran sulfate esters wherein a sulfuric acid group and a carboxyalkyl group are present in the form of an ester linkage and an ether linkage, respectively, in the molecule of dextran, and salts thereof; dextran phosphate esters wherein a phosphoric acid group is present in the form of an ester linkage in the molecule of dextran, and salts thereof; and hydroxyalkyl dextran having a hydroxyalkyl group introduced into the molecule of dextran.

Techniques for using these dextrans with silver halide photographic materials are known and are described in Japanese Patent Publication No. 11989/1960, U.S. Pat. No. 3,762,924, Japanese Patent Publication Nos. 12820/1970, 18418/1970, 40149/1970 and 31192/1971. These dextrans may be directly incorporated in silver halide emulsions or gelatin layers so as to improve the covering power of the developed silver image or to provide higher maximum density or contrast. Details of the process for producing these dextrans and derivatives thereof are found in the patents listed above.

For the synthesis of latices, the dextrans may be employed in any amounts within the range of 100–0.1 wt % of the weight of the monomer feed. If too much dextran is used, a highly viscous latex will form and a photographic colloidal solution containing this latex becomes too viscous to ensure easy coating operations. If the amount of dextran is too small, only a labile latex will result. Therefore, the dextrans are preferably used in amounts ranging from 30 to 0.1 wt %, more preferably from 15 to 0.5 wt %, of the weight of the monomer feed.

From the viewpoint of producing latices having high dispersion stability, dextran sulfate esters, carboxyalkyl dextran sulfate esters and dextran phosphate esters, each containing an introduced anionic group, are particularly preferable, with dextran sulfate esters being most preferable.

These modified products of dextran may be formed as follows: dextran sulfate esters may be obtained by allowing one of the dextrans mentioned above to react with a sulfating agent such as chlorosulfonic acid presence of a basic organic solvent such as pyridine or formamide; these dextran sulfate esters may be reacted with a carboxyalkylating agent such as monochlorocarboxylic acid to form carboxyalkyl agent such as monochlorocarboxylic acid to form carboxylalkyl dextran sulfate esters; carboxyalkyl dextrans may be obtained by allowing dextran to react with a carboxyalkylating agent such as monochlorocarboxylic acid in the presence of an alkali; these carboxyalkyl dextrans may be reacted with a sulfating agent such as chlorosulfonic acid in the presence of a basic solvent such as pyridine or formamide to form carboxyalkyl dextran sulfate esters; corresponding salts of the dextran sulfate esters and carboxyalkyl dextran sulfate esters may be obtained by reacting such esters with oxides of alkali metals (e.g., sodium and potassium), oxides or hydroxides of alkaline earth metals (e.g., calcium and magnesium) or ammonia.

Dextran has three hydroxyl groups that can be substituted per unit anhydrous glucose and, theoretically, dextran can be substituted with a sulfate ester group or carboxyalkyl group up to a substitution degree of 3. While substitution degrees of less than 3 are attainable by selecting appropriate reaction conditions, it should be emphasized that the sum of the degrees of substitution with sulfate ester and carboxyalkyl groups should not exceed 3.

Many types of the carboxylalkyl dextrans, dextran sulfate esters and carboxyalkyl dextran sulfate esters defined above can be produced by employing various combinations of the intrinsic viscosity of the starting dextran with the degrees of substitution by sulfate ester and carboxylalkyl groups in the modified product of dextran.

The latex used in the present invention may be stabilized by a protective colloid which is a synthetic hydrophilic polymer having both nonionic and anionic functional groups in the molecular structure. Examples of such synthetic hydrophilic polymers are those which contain in its molecular structure both a nonionic functional group such as an ether, ethylene oxide or hydroxyl group and an anionic functional group such as a sulfonic acid group or a salt thereof, a carboxylic acid group or a salt thereof, or a phosphoric acid group of a salt thereof. Hydrophilic polymers are those which have solubilities of 0.05 g or more in 100 g of water at 20° C. and which have number average molecular weights of 2000 or more. Hydrophilic polymers that are preferably used in the present invention are those which have both ethylene oxide and sulfonic acid groups and water solubilities of 0.1 g or more.

The synthetic hydrophilic polymers suitable for use in the present invention may contain a third component in addition to the nonionic and anionic functional groups which, in this case, are present in a total amount of at least 10 mol %, preferably at least 30 mol%. Specific examples of the hydrophilic polymers which are suitable for use in the present invention are listed below, with the molar ratio of each backbone chain being noted as a subscript:

| | | | Average molecular weight ($\overline{M}w$) |
|---|---|---|---|
| P-1 | $\left(CH_2-\underset{\underset{COOCH_2CH_2OH}{\vert}}{CH}\right)_{40}$ | $\left(CH_2-\underset{\underset{CONHC(CH_3)_2CH_2SO_3Na}{\vert}}{CH}\right)_{60}$ | ($\overline{M}n$ = 8000) |
| P-2 | $\left(CH_2-\underset{\underset{COO(C_2H_4O)_4H}{\vert}}{\overset{\overset{CH_3}{\vert}}{C}}\right)_{60}$ | $\left(CH_2-\underset{\underset{COOCH_2CH_2OP(=O)(ONa)_2}{\vert}}{CH}\right)_{40}$ | ($\overline{M}n$ = 4700) |

-continued

| | | | |
|---|---|---|---|
| P-3 | $\leftarrow CH_2-C(CH_3)\rightarrow_{70}$ (COO$(C_2H_4O)_{10}$—$C_4H_9$(t)) | $\leftarrow CH_2-CH\rightarrow_{30}$ (COOH) | ($\overline{M}n$ = 5500) |
| P-4 | $\leftarrow CH_2-C(CH_3)\rightarrow_{50}$ ($COOCH_2CH_2OH$) | $\leftarrow CH_2-C(CH_3)\rightarrow_{50}$ ($COOCH_2CH_2SO_3Na$) | ($\overline{M}n$ = 11000) |
| P-5 | $\leftarrow CH_2-CH\rightarrow_{30}$ (OH) | $\leftarrow CH_2-CH\rightarrow_{70}$ (CONH$C(CH_3)_2CH_2SO_3Na$) | ($\overline{M}n$ = 3200) |
| | $\leftarrow CH_2-C(CH_3)\rightarrow_m$ ($COOCH_2CH_2OH$) | $\leftarrow A\rightarrow_n$ | |

| | m | n | —A— | |
|---|---|---|---|---|
| P-6 | 50 | 50 | $\leftarrow CH_2-CH\rightarrow$ (COOH) | ($\overline{M}n$ = 7300) |
| P-7 | 40 | 60 | $\leftarrow CH_2-C(CH_3)\rightarrow$ (COOH) | ($\overline{M}n$ = 2700) |
| P-8 | 60 | 40 | $\leftarrow CH_2-C(CH_3)\rightarrow$ ($COOCH_2CH_2SO_3Na$) | ($\overline{M}n$ = 4800) |
| P-9 | 50 | 50 | $\leftarrow CH_2-CH\rightarrow$ ($SO_3Na$) | ($\overline{M}n$ = 11500) |
| P-10 | 60 | 40 | $\leftarrow CH_2-CH\rightarrow$ ($COOCH_2CH_2OP(=O)(ONa)_2$) | ($\overline{M}n$ = 8700) |
| P-11 | 40 | 60 | $\leftarrow CH_2-CH\rightarrow$ (CONH$C(CH_3)_2CH_2SO_3Na$) | ($\overline{M}n$ = 5300) |
| P-12 | 50 | 50 | $\leftarrow CH_2-CH\rightarrow$ (CONH$C(CH_3)(C_6H_5)CH_2SO_3Na$) | ($\overline{M}n$ = 7900) |
| P-13 | 50 | 50 | $\leftarrow CH_2-CH\rightarrow$ ($COOCH_2CH_2SO_3Na$) | ($\overline{M}n$ = 4900) |
| P-14 | 50 | 50 | $\leftarrow CH(COOH)-CH(COOH)\rightarrow$ | ($\overline{M}n$ = 2800) |

-continued

| | | | |
|---|---|---|---|
| P-15 | $\leftarrow CH_2-C(CH_3)(COO(CH_2CH_2O)_4H)\rightarrow_{50}$ | $\leftarrow CH_2-C(CH_3)(COOCH_2CH_2SO_3Na)\rightarrow_{50}$ | ($\overline{Mn}$ = 6300) |
| P-16 | $\leftarrow CH_2-C(CH_3)(COO(CH_2CH_2O)_4H)\rightarrow_{50}$ | $\leftarrow CH_2-CH(C_6H_4SO_3Na)\rightarrow_{50}$ | ($\overline{Mn}$ = 10500) |
| P-17 | $\leftarrow CH_2-C(CH_3)(COO(CH_2CH_2O)_4H)\rightarrow_{50}$ | $\leftarrow CH_2-CH(C_6H_4SO_3Na)\rightarrow_{50}$ | ($\overline{Mn}$ = 7200) |
| P-18 | $\leftarrow CH_2-C(CH_3)(COOCH_2CH_2OH)\rightarrow_{40}$ | $\leftarrow CH_2-CH(C_6H_4SO_3Na)\rightarrow_{30}$ $\leftarrow CH_2-CH(COOC_4H_9)\rightarrow_{30}$ | ($\overline{Mn}$ = 14300) |
| P-19 | $\leftarrow CH_2-C(CH_3)(COOCH_2CH_2OH)\rightarrow_{10}$ | $\leftarrow CH_2-CH(COOCH_2CH_2SO_3Na)\rightarrow_{20}$ $\leftarrow CH_2-CH(COOCH_3)\rightarrow_{70}$ | ($\overline{Mn}$ = 15600) |

Some of the hydrophilic polymers used in the present invention may be readily synthesized by any known method such as solution polymerization, bulk polymerization or suspension polymerization. Synthesis by solution polymerization may proceed in the following manner: a monomeric mixture is dissolved in an appropriate solvent (e.g., ethanol, methanol or water) in an appropriate concentration (generally no more than 40 wt %, preferably 10–25 wt %, of the solvent) and subjected to copolymerization by heating at an appropriate temperature (e.g., 40°–120° C., preferably 50°–100° C.) in the presence of an initiator (e.g., benzoyl peroxide, azobisisobutyronitrile or ammonium persulfate); the reaction mixture is poured into a medium that will not dissolve the resulting copolymer; the product is then precipitated and dried so as to separate and remove any unreacted mixture. The copolymers suitable for use in the present invention have number average molecular weights ranging from 1,000 to 1,000,000, preferably from 2,000 to 200,000, as measured with Gel Permeation Chromatograph HLC-802A of Toyo Soda Manufacturing Co., Ltd. and determined in terms of standard polystyrene.

Synthesis Example (Compound P-11)

A mixture of 52 g (0.40 mol) of hydroxyethyl methacrylate, 137 g (0.60 mol) of sodium 2-acrylamido-2-methylpropanesulfonate, 5.0 g of 4,4-azobis(4-cyanovaleric acid) and 500 ml of a degassed water/ethanol (80/20 v/v %) solution was charged into a three-necked flask and heated at 80° C. for 10 hours. After completion of the reaction, the mixture was poured into an excess amount of acetone under vigorous agitation, whereupon the reaction product was precipitated. Subsequently, the precipitate was filtered, washed with acetone and dried at 60° C. in air so as to obtain P-11. The yield of this polymer was 180 g (95% of the theoretical value) and its number average molecular weight ($\overline{Mn}$) was 5,300.

The latex used in the present invention is stabilized by a protective colloid which is defined as a hydrophilic high-molecular weight compound that is present on the surfaces of hydrophobic particles and which serves to form a stable dispersion thereof in water. If the latex used in the present invention is stabilized by a protective colloid which is dextran or derivatives thereof, the resulting protective colloidal latex solution is not simply a mixture of the hydrophobic particles and dextran or derivatives thereof, and the dextran or derivatives thereof serve as a protective colloid as is evidenced by the facts that the dispersion of the hydrophobic particles has improved stability and that an aqueous solution of the hydrophilic polymer has a higher viscosity than the protective colloidal latex solution.

Stable latices suitable for use in the present invention may be prepared by the following specific methods:

(1) a resin obtained by polymerizing a polymerizable compound is dispersed, either directly or after being dissolved in a water-miscible organic solvent, in water or an aqueous solution containing a water-miscible organic solvent, and the natural water-soluble polymer or synthetic hydrophilic polymer specified by the present invention is added to the dispersion;

(2) a resin obtained by polymerizing a polymerizable compound is dispersed, either directly or after being dissolved in a water-miscible organic solvent, in an aqueous solution having dissolved therein the natural water-soluble polymer or synthetic hydrophilic polymer specified by the present invention;

(3) a polymerizable compound is emulsion-polymerized in water in the presence of a small amount of surfactant, and the natural water-soluble polymer or synthetic hydrophilic polymer specified by the present invention is added to the resulting polymer emulsion; and (4) the natural water-soluble polymer or synthetic hydrophilic polymer specified by the present invention is dissolved in water or an aqueous solution containing a water-miscible organic solvent and, thereafter, a polymerizable compound is added to the solution and subjected to polymerization.

In method (3), if the emulsion containing the natural water-soluble or synthetic hydrophilic polymer specified by the present invention is heated to 50° C. or higher and then cooled, an even more stable latex will be obtained.

Of the four methods described above, method (4) is most preferable for the purpose of attaining a highly stable latex having a uniform particle size.

The latex used in the present invention is made of a hydrophobic polymer which is largely classified as a condensation polymer and a vinyl-based polymer. Illustrative condensation polymers include polyamides, polypeptides, polyesters, polycarbonates, polyacid anhydrides, polyurethanes, polyureas and polyethers. The vinyl-based polymer is an addition polymer of a vinyl compound and may be illustrated by homopolymers of aliphatic hydrocarbons, aromatics, vinyl alcohols, nitriles, acrylics, methacrylics, acylonitriles and halides or copolymers of combinations of these monomers.

By means of a protective colloid which is the natural water-soluble polymer or modified product thereof or the synthetic hydrophilic polymer which are specified by the present invention, hydrophobic polymers of any composition can be incorporated stably in hydrophilic colloidal layers such as silver halide emulsion layers. Therefore, as far as the performance of latex is concerned, there is no particular limitation on the composition of latex that can suitably be used in the present invention but from the viewpoint of ease of manufacture, latices based on polyesters or vinyl polymers are preferably selected. Illustrative starting monomers include: acrylic acid and esters thereof, methacrylic acid and esters thereof, crotonic acid and esters thereof, vinyl esters, maleic acid and diesters thereof, fumaric acid and diesters thereof, itaconic acid and diesters thereof, olefins, styrenes, acrylamides, methacrylamides, allyl compounds, vinyl ethers, vinyl ketones, polyfunctional monomers, vinyl heterocyclic compounds, glycidyl esters and unsaturated nitriles.

Specific examples of the polymerizable unsaturated compounds are listed below:

acrylic acid esters such as methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octyl acrylate, tertoctyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (number of moles added=9), 1-bromo-2-methoxyethyl acrylate, and 1,1-dichloro-2-ethoxyethyl acrylate;

methacrylic acid esters such as methyl methacrylate, ethyl methacrylate, n-propyl methacrylate, isopropyl methacrylate, n-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)-ethyl methacrylate, dimethyl aminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)-ethyl methacrylate, 2-(2-ethoxyethoxy)ethyl methacrylate, 2-(2-butoxyethoxy)ethyl methacrylate, and ω-methoxypolyethylene glycol methacrylate (number of moles added=6);

vinyl esters such as vinyl acetate, vinyl propionate, vinyl butyrate, vinyl isobutyrate, vinyl caproate, vinyl chloroacetate, vinyl methoxy acetate, vinyl phenyl acetate, vinyl benzoate and vinyl salicylate; olefins such as dicyclopentadiene, ethylene, propylene, 1-butene, 1-pentene, vinyl chloride, vinylidene chloride, isoprene, chloroprene, butadiene, and 2,3-dimethyl butadiene;

styrenes such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinyl benzoate;

crotonic acid esters such as butyl crotonate and hexyl crotonate;

itaconic acid diesters such as dimethyl itaconate, diethyl itaconate and dibutyl itaconate;

maleic acid diesters such as diethyl maleate, dimethyl maleate and dibutyl maleate;

fumaric acid diesters such as diethyl fumarate, dimethyl fumarate and dibutyl fumarate;

acrylamides such as acrylamide, methylacrylamide, ethylacrylamide, propylacrylamide, butylacrylamide, tertbutylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, 8-cyanoethylacrylamide, and N-(2-acetoacetoxyethyl)acrylamide;

methacrylamides such as methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethyl methacrylamide, methoxyethyl methacrylamide, dimethylaminoethyl methacrylamide, phenylmethacrylamide, dimethylmethacrylamide, diethylmethacrylamide, β-cyanoethylmethacrylamide, and N-(2-acetoacetoxyethyl)methacrylamide;

allyl compounds such as allyl acetate, allyl caproate, allyl laurate and allyl benzoate;

vinyl ethers such as methyl vinyl ether, butyl vinyl ether, hexyl vinyl ether, methoxyethyl vinyl ether and dimethylaminoethyl vinyl ether;

vinyl ketones such as methyl vinyl ketone, phenyl vinyl ketone and methoxyethyl vinyl ketone;

vinyl heterocyclic compounds such as vinylpyridine, N-vinylimidazole, N-vinyloxaazolidone, N-vinyltriazole and N-vinylpyrrolidone;

glycidyl esters such as glycidyl acrylate and glycidyl methacrylate;

unsaturated nitriles such as acrylonitrile and methacrylonitrile;

polyfunctional monomers such as divinylbenzene, methylenebisacrylamide and ethylene glycol dimethacrylate;

acrylic acid; methacrylic acid; itaconic acid; maleic acid; monoalkyl esters of itaconic acid such as monomethyl itaconate, monoethyl itaconate and monobutyl itaconate; monoalkyl esters of maleic acid such as monomethyl maleate, monoethyl maleate and monobutyl maleate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid and acryloyloxypropylsulfonic acid; methacryloyloxyalkylsulfonic acids such as methacryloyloxymethylsulfonic acid, methacryloyloxyethylsulfonic acid and methacryloyloxypropylsulfonic acid; acrylamidealkylsulfonic acids such as 2-acrylamido-2-methylethanesulfonic acid, 2-acrylamido-2-methylpropanesulfonic acid and 2-acrylamido-2-methylbutanesulfonic acid; methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid; acryloyloxyalkyl phosphates such as acryloyloxyethyl phosphate, 3-acryloyloxypropyl-2-phosphate; methacryloyloxyalkyl phosphates such as methacryloyloxyethyl phosphate and 3-methacryloyloxypropyl-2-phosphate; and sodium 3-allyloxy-2-hydroxypropanesulfonate having two hydrophilic groups.

The above-mentioned acids may be converted into salts of alkali metals (e.g., Na and K) or ammonium ion. Other usable polymerizable unsaturated compounds are the crosslinking monomers mentioned in U.S. Pat. Nos. 3,459,790, 3,438,708 3,554,987, 4,215,195 and 4,247,673, and Japanese Patent Application (OPI) No. 205735/1982. Illustrative crosslinking monomers are N-(2-acetoacetoxyethyl)acrylamide and N-{2-(2-acetoacetoxyethyoxy)ethyl}acrylamide.

The above-listed polymerizable unsaturated compounds are roughly divided into hydrophobics and hydrophilics. If hydrophilic unsaturated compounds are used, they are preferably combined with hydrophobic unsaturated compounds for the purpose of forming stable latices. Needless to say, these unsaturated compounds may be used either independently or in combination with themselves.

Some of the compounds listed above are water-soluble but they may be copolymerized with hydrophobic compounds to produce hydrophobic polymers.

The latices suitable for use in the present invention may be prepared by various methods such as one wherein hydrophobic polymers formed by solution polymerization are dispersed in water with the aid of surfactants or organic solvents, as well as suspension polymerization and emulsion polymerization which is to be carried out within aqueous media. Suspension polymerization and emulsion polymerization require fewer steps and hence are preferable.

Initiators suitable for use in polymerization of vinyl monomers include: azo compounds such as azobisisobutyronitrile, 2,2'-azobis-(2,4-dimethylvaleronitrile), dimethyl 2,2'-azobisisobutyrate, 2,2'-azobis(4-methoxy-2,4-dimethylvaleronitrile), 1,1'-azobis(cyclohexanone-1-carbonitrile), dimethyl 2,2-azobisisobutyrate, 4,4'-azobis-4-cyanovaleric acid, sodium 4,4'- azobis-4-cyanovalerate, and 2,2'-azobis(2-amidinopropane)-hydrochloride; peroxides such as benzoyl peroxide, lauryl peroxide, cumene hydroperoxide, diisopropyl peroxydicarbonate, t-butylhydroperoxide, di-tert-butyl peroxide, dicumyl peroxide and hydrogen peroxide; persulfate such as potassium persulfate, ammonium persulfate and sodium persulfate; and potassium bromate and ammonium cerium (IV) nitrate.

The peroxides or persulfates may be combined with suitable reducing agents so that they will also serve as redox initiators. Preferable initiators are those which are water-soluble.

The polymerization temperature varies with the initiator used and is generally within the range of 30°–95° C., preferably between 40° and 85° C.

If method (4) is employed to prepare the latices intended to be used in the present invention, it is recommended to avoid the use of anionic, nonionic and cationic surfactants which are commonly employed in emulsion polymerization. It should however be noted that such surfactants may be used if their types and contents are not detrimental to the purpose of the present invention. In this case, those surfactants which are commonly incorporated in phtotographic emulsions are preferably added to the latex fluid as obtained by polymerization.

In accordance with the present invention, the latex specified above is employed in an amount, based on weight, ranging from 10% to 300%, preferably from 30% to 200%, of gelatin. If the amount of latex used is too small, the desired advantages of the present invention will not be fully attained. If the amount of latex used is excessive, a coating having satisfactory strength cannot be formed. If the latex is stabilized by a protective colloid which is the natural water-soluble polymer specified in the present invention, said polymer is used in an amount, on a weight basis, ranging from 0.5% to 30%, preferably from 1% to 15%, of the latex. If the amount of the natural water-soluble polymer used is too small, the desired advantages of the present invention will not be fully attained, and if the amount of the polymer is excessive, the applicability of gelatin, especially its coating at high speed, is impaired.

If the latex is stabilized by a protective colloid which is the synthetic hydrophilic polymer specified in the present invention, this polymer is used in an amount, on a weight basis, ranging from 30% to 0.1%, preferably 15% to 0.5%, of the latex.

Preferable embodiments of the present invention for preparing appropriate latices are described below. One of the natural water-soluble polymers and synthetic hydrophilic polymers specified by the present invention is dissolved in water or in an aqueous solution containing a water-miscible organic solvent; the resulting solution is heated and degassed with agitation and, after a predetermined temperature is reached, a polymerization initiator is added; subsequently, an appropriate polymerizable unsaturated compound or compounds are added, optionally dropwise, to the solution and polymerization is carried out for a predetermined period; the reaction mixture is then cooled.

Alternatively, the natural water-soluble polymer or synthetic hydrophilic polymer may be first heated and degassed before being dissolved in water or in an aqueous solution containing a water-miscible organic solvent. The addition of a polymerization initiator may precede the heating and degassing of the polymer.

Several examples of latex synthesis are shown below.

(1) Dextran having an intrinsic viscosity of 0.210 was charged into a four-necked flask (capacity: 1,000 ml) equipped with a stirrer, a thermometer, a dropping funnel, a nitrogen feed tube and a reflux condenser. Four and a half grams of sodium dextran sulfate that was prepared in accordance with the method described in Synthesis Example 1 in Japanese Patent Publication No. 12820/1970 was added into the flask and, after the addition of pure water (350 ml), the temperature in the flask was raised to 80° C. while nitrogen gas was supplied. The supply of nitrogen gas continued for 30 more minutes after the temperature in the flask had reached 80° C. Thereafter, a solution having 0.45 g of ammonium persulfate dissolved in 10 ml of water was added as a polymerization initiator, and a mixture of butyl acrylate (40 g) and styrene (50 g) as polymerizable compounds was added dropwise through a dropping funnel over a period of about 1 hour. Five hours after the addition of the initiator, the reaction mixture was cooled, adjusted to a pH of 6 with aqueous ammonia and filtered to remove any dirt and coarse particles. By these procedures, a latex fluid (1-a) was obtained.

(2) A latex fluid (1-b) was prepared by repeating Synthesis (1) except that 39.5 g of butyl acrylate, 49.5 g of styrene and 1 g of acrylic acid were used as polymerizable compounds in mixture.

(3) A latex fluid (1-c) was prepared by repeating Synthesis (1) except that 50 g of butyl acrylate, 35 g of styrene and 5 g of maleic anhydride were used as polymerizable compounds in mixture.

(4) A latex fluid (1-d) was prepared by repeating Synthesis (1) except that 90 g of ethyl acrylate was polymerized at 70° C. with potassium persulfate being used as an initiator.

(5) A latex fluid (1-e) was prepared by repeating Synthesis (1) except that the amount of sodium dextran sulfate was reduced to 0.9 g.

(6) A latex fluid (1-f) was prepared by repeating Synthesis (1) except that 90 g of ethyl acrylate was polymerized at 40° C with ammonium persulfate (0.45 g) and sodium hydrogensulfite (0.22 g) being used as initiators.

(7) A latex fluid (1-g) was prepared by repeating Synthesis (4) except that 85 g of ethyl acrylate and 5 g of 2-acrylamido-2-methylpropanesulfonate were used as polymerizable compounds in admixture.

(8) A latex fluid (1-h) was prepared by repeating Synthesis (1) except that the amount of sodium dextran sulfate was increased to 13.5 g.

(9) A latex fluid (1-i) was prepared by repeating Synthesis (1) except that the sodium dextran sulfate was replaced by 3.5 g of the carboxymethyl dextran shown in Synthesis Example 2 in Japanese Patent Publication No. 12820/1970.

(10) A latex fluid (1-j) was prepared by repeating Synthesis (1) except that the sodium dextran sulfate was replaced by 3.5 g of the carboxymethyl dextran sulfate shown in Synthesis Example 1 in Japanese Patent Publication No. 12820/1970.

(11) A latex fluid (1-k) was prepared by repeating Synthesis (1) except that the sodium carboxymethyl dextran sulfate was replaced by 3.5 g of a commercial dextran having a weight average molecular weight ($\overline{Mw}$) of 100,000–20,000.

(12) Dioxane (90 ml) was charged into a four-necked flask (300 ml) equipped with a stirrer, a thermometer, a nitrogen feed pipe and a reflux condenser. After nitrogen was supplied, the temperature in the flask was raised to 70° C. and nitrogen gas supplied for an additional 30 minutes. After the supply of nitrogen gas was stopped, 60 g of butyl acrylate, 30 g of styrene, and a solution having 0.3 g of azobisisobutyronitrile in 10 ml of dioxane were added. Polymerization was subsequently carried out for 12 hours at 70° C.

A mixed solvent of water (240 ml) and ethanol (120 ml) was heated to 70° C. and 4.5 g of sodium dextran sulfate was dissolved in the heated solvent. To resulting solution, the previously obtained polymerization fluid was added while hot. The mixture was vigorously stirred and cooled to form a latex fluid (1-l).

(13) A nitrogen-purged autoclave equipped with a stirrer was charged with 55 parts by weight of styrene, 42 parts by weight of butadiene, 3 parts by weight of glycidyl methacrylate, 3 parts by weight of a sulfate ester, 0.2 parts by weight of tertiary dodecyl mercaptan, 0.3 parts by weight of tertiary pottasium phosphate, 0.3 parts by weight of ammonium persulfate and 100 parts by weight of water. Polymerization was conducted at 50° C. for 18 hours at a pressure of 5 atmospheres. After completion of the reaction, the residual monomers were distilled off to obtain a latex fluid (1-m).

(14) A reactor equipped with a stirrer, a thermometer, a nitrogen feed pipe, a distiller and a heater was charged with 192.1 g (1.0 mole) of trimellitic anhydride, 62.1 g (1.0 mole) of ethylene glycol and 108.1 g (1.0 mole) of benzyl alcohol.

The mixture was heated to 150° C. and held at that temperature for 4 hours with agitation. Water was then allowed to be distilled off and the temperature of the mixture was raised to 190° C. over a period of about 9 hours, then elevated to 205° C.

The polyester obtained was recovered and cooled to solidify. A portion (100 g) of the solid polyester was dissolved in 250 ml of acetone and the resulting solution was slowly poured, with vigorous agitation, into 100 ml of aqueous ammonia (ca 0.1 molar concentration) having 2.5 g of sodium dextran sulfate dissolved therein. The resulting mixture was filtered and acetone was removed by heating up to 60° C. By these procedures, a latex fluid (1-n) was obtained.

The above-described synthesis examples show that they could be emulsion-polymerized with great ease in aqueous solutions containing natural water-soluble polymers, especially glucose polymers or derivatives thereof without employing any of the common emulsifiers at all. It is therefore clear that the natural water-soluble polymers specified by the present invention are highly effective as protective colloids.

(15) A four-necked flask (1,000 ml) equipped with a stirrer, a thermometer, a dropping funnel, a nitrogen feed pipe and a reflux condenser was charged with 350 ml of pure water and the temperature in the flask was elevated to 80° C. with nitrogen gas being fed into the flask. After the temperature in the flask reached 80° C., the supply of nitrogen gas was continued for an additional 30 minutes. After 4.5 g of a synthetic hydrophilic polymer (P-11) was added, a solution having 0.45 g of ammonium persulfate (initiator) dissolved in 10 ml of water was charged into the flask. Thereafter, a mixture of butyl acrylate (40 g) and styrene (50 g) was added dropwise through a dropping funnel over a period of about 1 hour. FIve hours after the addition of the initiator, the reaction mixture was cooled, adjusted to a pH of 6 with aqueous ammonia and filtered to remove any dirt and coarse particles. By these procedures, a latex fluid (2-a) was obtained.

(16) A latex fluid (2-b) was prepared by repeating Synthesis (15) except that 39.5 g of butyl acrylate, 49.5 g of styrene and 1 g of acrylic acid were used as polymerizable compounds in mixture.

(17) A latex fluid (2-c) was prepared by repeating Synthesis (15) except that 90 g of ethyl acrylate was polymerized at 70° C. with potassium persulfate being added as an initiator.

(18) A latex fluid (2-d) was prepared by repeating Synthesis (15) except that P-11 was replaced by P-9.

(19) A latex fluid (2-e) was prepared by repeating Synthesis (16) except that P-11 was replaced by P-9.

(20) A latex fluid (2-f) was prepared by repeating Synthesis (17) except that P-11 was replaced by P-9.

(21) A nitrogen-purged autoclave equipped with a stirrer was charged with 55 parts by weight of styrene, 42 parts by weight of butadiene, 3 parts by weight of glycidyl methacrylate, 3 parts by weight of P-11, 0.2 parts by weight of tertiary dodecyl mercaptan, 0.3 parts by weight of tertiary potassium phosphate, 0.3 parts by weight of ammonium persulfate and 100 parts by weight of water. Polymerization was conducted at 50° C. for 18 hours at a pressure of 5 atmosphere. After completion of the reaction, the residual monomers were distilled off to obtain a latex fluid (2-g).

(22) A reactor equipped with a stirrer, a thermometer, a nitrogen feed pipe, a distiller and a heater was charged with 192.1 g (1.0 mole) of trimellitic anhydride, 62.1 g (1.0 mole) of ethylene glycol and 108.1 g (1.0 mole) of benzyl alcohol. The mixture was heated to 150° C. and held at that temperature for 4 hours with stirring. Water was then allowed to be distilled off and the temperature of the mixture was gradually raised to 190° C. over a period of about 9 hours, then elevated to 205° C.

The polyester obtained was recovered and cooled to solidify. A portion (100 g) of the solid polyester was dissolved in 250 ml of acetone. The resulting acetone solution was slowly poured, with vigorous agitation, into 100 ml of an aqueous solution of P-11 having a molar concentration of about 0.1. The mixture was filtered and acetone was removed by heating up to 60° C. By these procedures, a latex fluid (2-h) was obtained.

A number of surfactants are employed in silver halide photographic materials. According to the studies conducted by the present inventors, when latices employing conventional surfactants as dispersion stabilizers (emulsifiers) were incorporated in silver halide emulsion layers, the surfactants present in the silver halide photographic material were adsorbed onto the surfaces of the latex particles or the surfactants that had been employed in polymerization were desorbed from the latex particles, thereby causing serious effects on the photographic performance of said material.

On the other hand, the latices that had been stabilized by a protective colloid which is one or more of the natural water-soluble polymers or synthetic hydrophilic polymers specified by the present invention adsorbed too small amounts of surfactants to cause pronounced effects on the performance of the photographic material. This is presumably because of the very slow rate of desorption of the polymer coat from the surfaces of latex particles in a protective colloid form. The polymer coat would cause extremely small effects on the photographic performance because it forms a sufficiently thick protective colloid layer having satisfactory adsorptive power with high density of adsorption sites. For the reasons stated above, the latex prepared in accordance with the present invention is a useful substance that can be incorporated in every type of silver halide photographic materials for various purposes without causing any adverse effects on silver halide emulsions. For instance, the latex may be used as a dimension-stabilizing binder latex, an impregnation latex for helping hydrophobic, photographically useful compounds to be dispersed in hydrophilic colloid layers, a subbing latex, or as a latex for incorporation in a matting agent, a mordanted layer or a neutralizing layer.

The latex that has been converted into a protective colloid by treatment with the natural water-soluble polymer or synthetic hydrophilic polymer in accordance with the present invention is primarily intended to be incorporated in a silver halide emulsion layer, but, if desired, it may of course be incorporated in other photographic layers such as protective layers, intermediate layers, anti-halation layers, subbing layers, backing layers, mordanted layers and neutralizing layers.

Gelatin is advantageously employed in hydrophilic colloid layers and it may be used incombination with gelatin derivatives. Illustrative gelatins that may be used include lime-treated gelatin and acid-treated gelatins of the types described in Bulletin of the Society of Scientific Photography of Japan, No. 16, 30, 1966. Hydrolytic or enzymolytic products of gelatin may also be used. Usable gelatin derivatives include are those which are prepared by reacting gelatin with such compounds as acid halides, acid anhydrides, isocyanates, bromoacetic acid, alkanesultones, vinylsulfonamides, maleinimide compounds, polyalkylene oxides, and epoxy compounds. Specific examples of such gelatin derivatives are mentioned in U.S. Pat. Nos. 2,614,928, 3,132,945, 3,186,846, 3,312,553, British Patent Nos. 861,414, 1,033,189, 1,005,784, and Japanese Patent Publication No. 26845/1967.

The silver halide emulsion used in the present invention may employ any of the silver halides that are commonly used in ordinary silver halide emulsions such as silver bromide, silver iodobromide, silver iodochloride, silver chlorobromide and silver chloride.

The silver halide grains may have a uniform silver halide composition throughout or they may be of the core/shell type which has different silver halide compositions as between the interior and the surface layer. The silver halides may be of the surface latent image type or of the internal latent image type.

The silver halide grains used in the silver halide emulsion in accordance with the present invention may have regular crystal shapes such as cubic, octahedral and tetradecahedral forms. The grains may have anomalous crystal shapes such as spherical and tabular forms. These grains may have any desired values for the ratio of {100} to 111} faces. The grains may have combinations of various crystal forms, or grains having different crystal forms may be used in mixture.

The average grain size (expressed as the diameter of an equivalent circle having the same area as the projected area) of silver halide grains is preferably not more than 5 μm, with 3 μm or less being more preferable.

The silver halide emulsion used in the present invention may have any pattern of grain size distribution, broad or narrow. Emulsions having a broad distribution (referred to as polydispersed emulsions) may be used either independently or in combination. Also suitable for use are emulsions having a narrow distribution (i.e., monodispersed emulsions which may be defined as those emulsions whose standard deviation of size distribution divided by the average grain size is no more than 0.20; the grain size is expressed as the diameter of a spherical grain and as the diameter of an equivalent circle for the projected area of a non-spherical grain). Polydispersed emulsions may be used in combination with monodispersed emulsions.

Two or more silver halide emulsions that are prepared separately may be employed in combination with each other.

The silver halide emulsion used in the present invention may be chemically sensitized by any of the routine methods such as sulfur sensitization, selenium sensitization, reduction sensitization and noble metal sensitization employing gold and other noble metal compounds. These sensitization techniques may be employed either independently or in combination.

Dye-forming couplers may be incorporated in silver halide emulsion layers so as to formulate color light-sensitive materials.

The advantages of the present invention are hereunder described in greater detail by reference to the following working examples to which the possible embodiments of the invention are by no means limited.

EXAMPLE 1

To a gelatin-dispersed silver chloroiodobromide emulsion containing 75 mol % of silver chloride, 24 mol % of silver bromide and 1 mol % of silver iodide, 0.6 g, per mole of silver halide, of 4-hydroxy-6-methyl-1,3,3a,7-tetrazaindene, 1.0 g, per gram of gelatin on a dry basis, of one of the latices (1-a to 1-m) prepared in accordance with the present invention or the comparative latices (A to G), and mucochloric acid were added. The coating solution thus prepared was applied to a subbed polyethylene terephthalate base for a silver deposit of 4.0 g/m$^2$ and a total gelatin and latex content of 1.9 g/m$^2$.

Preparation of comparative latices (1) A comparative latex (A) was prepared by repeating Synthesis (1) except that sodium dextran sulfate was replaced by 7.0 g of sodium dodecylbenzenesulfonate.

(2) A comparative latex (B) was prepared by repeating Synthesis (2) except that sodium dextran sulfate was replaced by 7.0 g of sodium dodecylbenzenesulfonate.

(3) A comparative latex (C) was prepared by repeating Synthesis (3) except that sodium dextran sulfate was replaced by 5.0 g of an activating agent having the following structure:

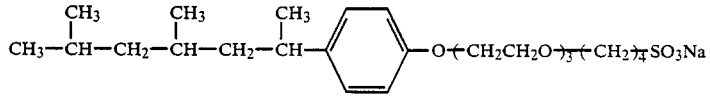

(4) A comparative latex (D) was prepared by repeating Synthesis (4) except that sodium dextran sulfate was replaced by 6.0 g of an activating agent having the following structure:

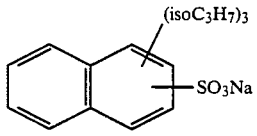

(5) A comparative latex (E) used poly(vinyl alcohol) as a protective colloid and was prepared by performing polymerization in accordance with the method described in Japanese Patent Publication No. 47371/1980.

(6) A comparative latex (F) was a copolymer of water-soluble monomers that was prepared by performing polymerization in accordance with the method described in Japanese Patent Application (OPI) No. 130217/1976.

(7) A reactor equipped with a stirrer, a thermometer, a nitrogen feed pipe, a distiller and a heater was charged with 192.1 g (1.0 mole) of trimellitic anhydride, 62.1 g (1.0 mole) of ethylene glycol and 108.1 g (1.0 mole) of benzyl alcohol. The mixture was heated to 150° C. and held at that temperature for 4 hours with agitation. Water was then allowed to be distilled off and the temperature of the mixture was gradually raised to 190° C. over a period of about 9 hours, and further elevated to 205° C.

The polyester product was recovered and cooled to solidify. A portion (100 g) of the solid polyester was dissolved in 250 ml of acetone and the resulting acetone solution was slowly poured, with vigorous agitation, into 100 ml of aqueous ammonia with a molar concentration of about 0.1 which had 2.5 g of sodium dodecylbenzene sulfonate dissolved therein. The mixture was filtered and acetone was removed by heating up to 60° C. By these procedures, a latex (G) was obtained.

The samples of photographic material were visually checked for the occurrence of any cissing in the applied emulsion layers. The samples were then exposed through an optical wedge and processed photographically according to the scheme shown below. The processed samples were checked for the sensitivity, fogging, dimensional stability, devitrification and cissing. The results are shown in Table 1.

Processing scheme

| Processing scheme: | | |
|---|---|---|
| Steps | Temperature (°C.) | Time (sec) |
| Development | 29 | 30 |
| Fixing | 28 | 20 |
| Washing | 20 | 20 |
| Drying | 45 | 30 |

| Developer (stock solution): | |
|---|---|
| Potassium bromide | 2.5 g |
| Ethylenediaminetetraacetic acid disodium salt | 1 g |
| Potassium sulfite (55% aq. sol.) | 90 ml |
| Potassium carbonate | 25 g |
| Hydroquinone | 10 g |
| 5-Methylbenzotriazole | 100 mg |
| 5-Nitrobenzotriazole | 100 mg |
| 1-Phenyl-5-mercaptotetrazole | 30 mg |
| 5-Nitroindazole | 50 mg |
| 1-Phenyl-4-methyl-4-hydroxymethyl-3- | 0.5 g |

-continued

| | |
|---|---|
| pyrazolidone | |
| Diethylene glycol | 60 g |
| Sodium hydroxide | amount necessary to attain a pH of 10.6 |
| Water | to make 500 ml (pH, 10.6) |

This stock solution was diluted two-fold with water just prior to use.

Fixing solution

| Fixing solution: | |
|---|---|
| (Part A) | |
| Ammonium thiosulfate | 170 g |
| Sodium sulfite | 15 g |
| Boric acid | 6.5 g |
| Glacial acetic acid | 12 ml |
| Sodium citrate (dihydrate) | 2.5 g |
| Water | to make 275 ml |
| (Part B) | |
| Aluminum sulfate (18 $H_2O$) | 15 g |
| 98% Sulfuric acid | 2.5 g |
| Water | to make 40 ml |

Just prior to use, 275 ml of part A was mixed with about 600 ml of water and 40 ml of part B, and the mixture was worked up to a volume of 1,000 ml by addition of water.

Sensitivity

Sensitivity measurements were conducted with a sensitometer KS-1 of Konishiroku Photo Industry Co., Ltd. Sensitivity was expressed as the reciprocal of the exposure necessary to provide a density equal to fog+0.7. The sensitivity data were given in terms of relative values, with the day 0 sensitivity of sample No. 1 being taken as 100.

Dimensional stability

The change in the dimensions of each sample resulting from development processing was measured with a bingage. The dimensional change of an exposed sample having a length of 200 mm can be calculated by the following formula:

$$\textit{Dimensional change}\ (\%)=\{(Y-X)/200\}\times 100$$

where X is the length (mm) of the virgin sample and Y is the length (mm) of the processed sample.

Calculated dimensional changes ±0.01% are considered to be the upper limit for the practically tolerable dimensional change in the art.

Devitrification

The loss of transparency in the films that had been developed and washed with water was evaluated by visual checking: films that remained completely transparent were rated A, those turning milk-white by a very small degree were rated B, and those which turned slightly milk-white were given rating C.

Cissing

The number of locations where cissing occurred in a coated area of 30 cm×30 cm was counted visually.

TABLE 1

| Sample No. | Latex | Photographic characteristics: specific sensitivity | Photographic characteristics: fog | Dimensional change (%) | Devitrification | Cissing |
|---|---|---|---|---|---|---|
| Samples of the invention | | | | | | |
| 1-1 | 1-a | 100 | 0.06 | 0.005 | A | 0 |
| 1-2 | 1-b | 101 | 0.05 | 0.004 | A | 0 |
| 1-3 | 1-c | 101 | 0.05 | 0.005 | A | 0 |
| 1-4 | 1-d | 100 | 0.06 | 0.004 | A | 0 |
| 1-5 | 1-e | 100 | 0.06 | 0.005 | A | 0 |
| 1-6 | 1-f | 100 | 0.06 | 0.005 | A | 0 |
| 1-7 | 1-g | 101 | 0.06 | 0.005 | A | 0 |
| 1-8 | 1-h | 100 | 0.05 | 0.004 | A | 0 |
| 1-9 | 1-i | 101 | 0.06 | 0.005 | A | 0 |
| 1-10 | 1-j | 100 | 0.06 | 0.005 | A | 0 |
| 1-11 | 1-k | 100 | 0.05 | 0.005 | A | 0 |
| 1-12 | 1-l | 101 | 0.06 | 0.005 | A | 0 |
| 1-13 | 1-m | 98 | 0.06 | 0.005 | A | 0 |
| 1-14 | 1-n | 97 | 0.06 | 0.005 | A | 0 |
| Comparative samples | | | | | | |
| 1-15* | A | 76 | 0.12 | 0.020 | A | 0 |
| 1-16 | B | 74 | 0.11 | 0.005 | B | 0 |
| 1-17 | C | 77 | 0.11 | 0.006 | A | 0 |
| 1-18 | D | 72 | 0.12 | 0.006 | A | 0 |
| 1-19 | E | 94 | 0.08 | 0.005 | C | 15 |
| 1-20 | F | 95 | 0.07 | 0.005 | C | 10 |
| 1-21 | G | 71 | 0.09 | 0.006 | B | 5 |
| 1-22 | none | 100 | 0.06 | 0.022 | A | 0 |

*In order to prevent agglomeration in the coating solution, only 0.05 g of latex A per gram of gelatin was incorporated in sample No. 1-15.

As is clear from Table 1, sample Nos. 1-1 to 1-14 prepared in accordance with the present invention had low levels of fogging, exhibited high sensitivity, experienced very small dimensional changes and were entirely free from the occurrence of devitrification and cissing. Sample No. 1-22 which did not use any latex experienced a significantly large degree of dimensional change. Sample Nos. 1-15 to 1-18 which employed latices that were synthesized with the aid of low-molecular weight surfactants experienced serious deterioration in their photographic characteristics. Sample No. 1-19 using a known latex which incorporated PVA as a protective colloid had inferior photographic performance and suffered from marked devitrification and cissing. Sample No. 1-20 using a copolymer of water-soluble monomers as a latex also had inferior photographic performance and suffered from marked devitrification and cissing. Sample No. 1-21 using a latex wherein a hydrophobic polymer was dispersed with the aid of a low-molecular weight surfactant was also unsatisfactory in terms of photographic characteristics and resistance to devitrification and cissing.

EXAMPLE 2

To a gelatin-dispersed silver iodobromide high-sensitivity emulsion containing 98.5 mol% of silver bromide and 1.5 mol % of silver iodide, 1.2 g, per mole of silver halide, of 4-hydroxy-6-methyl-1,3,3a-7-tetrazaindene, 10 g of diethylene glycol, 1.0 g, per gram of gelatin on a dry basis, of one of the latices (1-a to 1-n) prepared in accordance with the present invention or comparative latices (A to G), and 2-hydroxy-4,6-dichloro-S-triazine sodium salt were added. The coating solution thus prepared was applied to both sides of a subbed polyethylene terephthalate base for a silver deposit of 4.0 g/m² and a total gelatin and latex content of 1.9 g/m².

The samples of photographic material were visually checked for the occurrence of any cissing in the applied emulsion layers. The samples were then exposed through an optical wedge and processed photographically according to the scheme shown below. The processed samples were checked for the sensitivity, fogging, dimensional stability and devitrification as in Example 1.

The samples were also subjected to a test for evaluating their resistance to pressure fogging. The results are shown in Table 2.

TABLE 2

| Sample No. | Latex | Fog density at bent portion | Photographic characteristics: Specific sensitivity | Photographic characteristics: fog | Dimensional change (%) | Devitrification | Cissing |
|---|---|---|---|---|---|---|---|
| Samples of the invention | | | | | | | |
| 2-1 | 1-a | 0.09 | 100 | 0.06 | 0.006 | A | 0 |
| 2-2 | 1-b | 0.10 | 99 | 0.06 | 0.006 | A | 0 |
| 2-3 | 1-c | 0.10 | 101 | 0.06 | 0.005 | A | 0 |
| 2-4 | 1-d | 0.08 | 102 | 0.06 | 0.006 | A | 0 |
| 2-5 | 1-e | 0.09 | 100 | 0.06 | 0.006 | A | 0 |
| 2-6 | 1-f | 0.11 | 100 | 0.06 | 0.005 | A | 0 |
| 2-7 | 1-g | 0.09 | 100 | 0.06 | 0.006 | A | 0 |
| 2-8 | 1-h | 0.10 | 100 | 0.06 | 0.006 | A | 0 |
| 2-9 | 1-i | 0.10 | 100 | 0.06 | 0.006 | A | 0 |
| 2-10 | 1-j | 0.11 | 102 | 0.06 | 0.005 | A | 0 |
| 2-11 | 1-k | 0.09 | 100 | 0.06 | 0.006 | A | 0 |
| 2-12 | 1-l | 0.09 | 101 | 0.06 | 0.006 | A | 0 |
| 2-13 | 1-m | 0.11 | 98 | 0.06 | 0.006 | A | 0 |
| 2-14 | 1-n | 0.10 | 97 | 0.06 | 0.006 | A | 0 |
| Comparative samples | | | | | | | |
| 2-15* | A | 0.17 | 61 | 0.13 | 0.022 | A | 0 |
| 2-16 | B | 0.16 | 58 | 0.14 | 0.007 | A | 0 |
| 2-17 | C | 0.15 | 54 | 0.14 | 0.006 | A | 0 |
| 2-18 | D | 0.14 | 52 | 0.13 | 0.006 | A | 0 |
| 2-19 | E | 0.14 | 84 | 0.08 | 0.006 | C | 17 |
| 2-20 | F | 0.17 | 88 | 0.08 | 0.007 | C | 12 |
| 2-21 | G | 0.15 | 60 | 0.16 | 0.006 | B | 6 |
| 2-22 | none | 0.45 | 97 | 0.07 | 0.024 | A | 0 |

*In order to prevent agglomeration in the coating solution, only 0.05 g of latex A per gram of gelatin was incorporated in sample No. 2-15.

As is clear from Table 2, sample Nos. 2–1 to 2–14 prepared in accordance with the present invention had low levels of fogging, exhibited high sensitivity, experienced very small dimensional changes and were entirely free from the occurrence of devitrification and cissing. Table 2 also shows that the latex specified by the present invention is effective in suppressing the occurrence of pressure fogging in high-sensitivity emulsions.

Pressure fogging

A sample was bent on a bending tester having a slit-to-slit distance of 2 mm. After the sample was developed and subjected to other photographic processing, the degree of pressure fogging that occurred was measured.

Processing scheme

| Steps | Processing scheme: Temperature (°C.) | Time (sec) |
|---|---|---|
| Development | 30 | 45 |
| Fixing | 25 | 35 |
| Washing | 15 | 35 |
| Drying | 45 | 20 |

The developing solution had the following composition.

| | |
|---|---|
| Phenidone | 0.4 g |
| Methol | 5 g |
| Hydroquinone | 1 g |
| Anhydrous sodium sulfite | 60 g |
| Hydrous sodium carbonate | 54 g |
| 5-Nitroimidazole | 100 mg |
| Potassium bromide | 2.5 g |
| Water | to make 1,000 ml |
| | (pH, 10.20) |

EXAMPLE 3

A sample of photographic material was prepared as in Example 1 except that latex (2-a) made in Synthesis Example (15) was used as the latex specified by the present invention. Two comparative samples were prepared as in Example 1 except that latex (2-a) was replaced by a latex fluid (x) which was made as in Synthesis Example (15) by using sodium dodecylbenzenesulfonate in place of P-11. An additional comparative sample was prepared without employing any latex.

Each of the samples thus prepared was exposed through an optical wedge and processed photographically as in Example 1. The processed samples were checked for the sensitivity, fogging and dimensional stability. The results are shown in Table 3.

Sensitivity

Sensitivity measurements were conducted with a sensitometer KS-1 of Konishiroku Photo Industry Co., Ltd. Sensitivity was expresses as the reciprocal of the exposure necessary to provide a density equal to fog+0.7. The sensitivity data were given in terms of relative values, with the day 0 sensitivity of the control sample being taken as 100.

Dimensional stability

The change in the dimensions of each sample resulting from development and subsequent processing was measured and calculated as in Example 1.

TABLE 3

| Sample No. | Latex | Specific sensitivity | Fog | Dimensional change (%) |
|---|---|---|---|---|
| 3-1 (sample of the invention) | latex 2-a | 100 | 0.05 | 0.005 |
| 3-2 (comparative sample) | latex "x"*1 | — | — | — |
| 3-3 (comparative sample) | no latex | 100 | 0.05 | 0.023 |
| 3-4 (comparative sample) | latex "x"*2 | 98 | 0.06 | 0.020 |

*1The coating solution containing latex (x) in an amount equal to that of gelatin underwent agglomeration and could not be applied to a substrate with satisfactory results.
*2The coating solution from which this sample was prepared contained 5 wt %, of gelatin, of latex (x) so that it could be applied to a substrate with satisfactory results.

As Table 3 shows, sample No. 3-1 prepared in accordance with the present invention exhibited high sensitivity while experiencing low levels of fogging; in addition, the dimensional change of this sample was much smaller than in comparative sample Nos. 3-3 and 3-4. It was also free from any of the agglomeration that occurred in comparative sample No. 3-2.

What is claimed is:

1. A silver halide photographic element comprising at least one silver halide emulsion layer on a support, said emulsion layer containing gelatin and 10 to 300 percent by weight, based upon said gelatin, of an aqueous latex, said aqueous latex consisting essentially of water and hydrophobic polymer particles, the surface of said hydrophobic polymer particles being coated with a substance selected from the group consisting of:
(a) a synthetic water-soluble polymer having, in side chains, (1) at least one non-ionic group selected from the group consisting of ethylene oxide, and hydroxyl groups; and (2) at least one anionic group, selected from the group consisting of sulfonic acid, a salt of sulfonic acid, carboxylic acid, a salt of carboxylic acid, phosphonic acid, and a salt of phosphonic acid, said hydrophobic polymer particles being coated with 0.1 to 30 percent by weight based on said hydrophobic polymer particles of said synthetic water-soluble polymer; and
(b) a glucose polymer, said hydrophobic polymer particles being coated with 0.5 to 30 percent by weight based on said hydrophobic polymer particles of said glucose polymer.

2. The photographic element of claim 1 wherein said substance comprises a glucose polymer.

3. The photographic element of claim 2 wherein said glucose polymer is selected from the group consisting of sulfonated glucose polymer, carboxylated glucose polymer, phosphated glucose polymer, sulfoalkylenated glucose polymer, carboxylalkylenated glucose polymer and alkylphosphated glucose polymer.

4. The photographic element of claim 2 wherein said glucose polymer is selected from the group consisting of dextran, dextran sulfate ester, carboxylated dextran sulfate ester and dextran phosphate ester.

5. The photographic material of claim 4 wherein said glucose polymer has an anionic group.

6. The photographic element of claim 1 wherein said latex comprises a hydrophobic polymer synthesized from polymerizable monomers in the presence of a glucose polymer.

7. The photographic element of claim 1 wherein the surfaces of the hydrophobic polymer particles are coated with a synthetic water-soluble polymer having, in side chains, at least one non-ionic group and at least one anionic group.

8. The photographic element of claim 7 wherein said latex comprises a hydrophobic polymer synthesized from polymerizable monomers in the presence of said water-soluble polymer.

* * * * *